United States Patent [19]

Tajkowski

[11] 4,083,756

[45] Apr. 11, 1978

[54] PROCESS FOR IMPROVING CORROSION RESISTANCE OF ANODIZED METAL SURFACES AND TREATED PRODUCT

[75] Inventor: Edward George Tajkowski, Williamsville, N.Y.

[73] Assignee: Allied Chemical Corporation, Morris Township, N.J.

[21] Appl. No.: 807,756

[22] Filed: Jun. 17, 1977

[51] Int. Cl.[2] ..... C25D 11/18

[52] U.S. Cl. ..... 204/35 N; 427/419 A

[58] Field of Search ..... 204/35 N; 427/419 A, 427/419 D

[56] References Cited

U.S. PATENT DOCUMENTS

| | | | |
|---|---|---|---|
| 3,012,917 | 12/1961 | Riou et al. | 204/35 N |
| 3,380,860 | 4/1968 | Lipinski | 204/35 N |
| 3,440,150 | 4/1969 | Kramer et al. | 204/35 N |
| 3,838,023 | 9/1974 | Friedemann | 204/35 N |

*Primary Examiner*—G. L. Kaplan
*Assistant Examiner*—William Leader
*Attorney, Agent, or Firm*—Alan M. Doernberg; Jay P. Friedenson

[57] ABSTRACT

Corrosion resistant anodized metal surfaces are produced by electrically oxidizing a metal such as aluminum or aluminum alloys to form an oxide layer of about 0.0002–0.001 inch, rinsing and sealing in a boiling aqueous solution of a polycarboxylic acid with perfluorinated portions such as $$[R_f(CX_2)_mCH_2\underset{|}{C}H(CX_2)_nCOOH]_2$$

wherein X is independently at each occurrence H or F, $m$ and $n$ are independently 0 to 10 and $R_f$ is $C_pF_{2p+1}$— where $p$ i 6 to 24 or $C_qF_{2q+1}O$—where $q$ is 3–12.

11 Claims, No Drawings

PROCESS FOR IMPROVING CORROSION RESISTANCE OF ANODIZED METAL SURFACES AND TREATED PRODUCT

BACKGROUND OF THE INVENTION

This invention relates to a process for improving the corrosion resistance of anodized metal surfaces, and particularly surfaces of aluminum metal that have been anodized to form an aluminum oxide layer.

Many of the agents used in the present invention are also disclosed for improving the drop-wise condensation properties of conversion coated metal in my U.S. Pat. No. 3,899,366 entitled "Treated Substrate For The Formation Of Drop-Wise Condensates And The Process For Preparing Same," which is incorporated herein by reference.

Anodized metal surfaces differ from conversion coated metal surfaces in both structure and suitability for various applications. As described in my U.S. Pat. No. 3,899,366, the conversion-coated metals are protected by a coating including chromium which is applied by a non-electrolytic process. In general, such coatings include chromium and a fraction of the underlying metal which, together, are more inert to chemical oxidation than the original metal. As disclosed in that patent, the coating with a fluorochemical improves the formation of drop-wise rather than film condensation on such surfaces which is particularly valuable in heat transfer surfaces such as cooling coils. It also improves corrosion resistance.

The sealing of anodized aluminum involves converting surface oxides such as $Al_2O_3$ to their hydrates. A similar process is sometimes used with magnesium, titanium and some other metals.

The present invention is concerned with anodized surfaces, and particularly anodized aluminum surfaces, which have different structures, properties and applications than conversion coated surfaces.

In general, conversion coated surfaces are known to be used in applications where brightness or color is not a factor or, if coloring is desired, may be painted over. Anodized coatings on aluminum may have color impregnated thereon before or during sealing with boiling water.

U.S. Pat. No. 3,012,917 relates to a method of treating anodically oxidized aluminum to provide a sealing or protective coating and utilizes chlorofluorinated carboxylic acids and/or salts of a polyfluorinated carboxylic acid. British patent specification No. 1,054,316 discloses other processes for sealing freshly anodized aluminum.

In addition, it is well known to provide fluorinated polymeric coatings to metal surfaces as for example polytetrafluoroethylene on non-stick cookware, corrosion-resistant chemical vessels and the like.

BRIEF DESCRIPTION OF THE INVENTION

It has been discovered that segmented, perfluorinated dicarboxylic acids and their salts are a superior sealing agent for anodized aluminum, even with surprisingly thin aluminum oxide layers. Thus the present invention includes the process of preparing a corrosion-resistant anodized metal substrate comprising the steps of anodizing the surface of the metal substrate by treatment with an oxidizing agent to produce a metal oxide coating from about 0.0002 to about 0.001 inch thick and immersing the anodized metal in an aqueous solution having a pH of about 5.5 to about 6.5 and having at least about 0.05 weight % of a segmented dicarboxylic acid or salt having a perfluorinated alkyl or alkoxy chain of at least three carbons and a coupling solvent, if required, at between about 98° C and 100° C for a sufficient time to seal the metal oxide coating. The preferred metal substrates are aluminum and aluminum alloys.

The invention also includes a metal substrate coated and sealed by the above process.

Suitable polycarboxylic acids include, for example, those having perfluorinated terminal segments such as $(CF_3)_2CF(CH_2)_n$— where $n$ is 6 to 24 or $C_qF_{2q+1}O$— where $q$ is 3 to 12 and/or perfluorinated intermediate segments such as —$(CF_2)_n$— where $n$ is 1 to 10. Preferred are the carboxylic acids of the formula $$\begin{array}{c} R_f(CX_2)_mCH_2CH(CX_2)_nCOOH \\ | \\ R_f(CX_2)_mCH_2CH(CX_2)_nCOOH \end{array}$$

wherein X is independently at each occurrence H or F, $m$ and $n$ are independently an integer of 0 to 10 and $R_f$ is $C_pF_{2p+1}O$— where $p$ is an integer of 6 to 24 or $C_qF_{2q+1}O$— where $q$ is an integer of 3 to 12, provided that when $q$ is less than 6, the adjacent $(CX_2)_m$ contains at least three perfluorinated carbons such as $(CF_2)_3$.

More preferred among these dicarboxylic acids are those of the formula $$\begin{array}{c} [C_qF_{2q+1}O(CF_2)_m(CH_2)_rCH(CX_2)_nCOOH]_2 \\ | \end{array}$$

wherein X is independently at each occurrence H or F, $n$ is an integer of 6 to 10, $q$ is an integer of 3 to 6, $r$ is an integer of 0–4 and $m$ is an integer of 4 to 8. Even more preferably, $q$ is 3. Salts of such acids and mixtures of such salts and acids are also more preferred.

Most preferred are dicarboxylic acids of the formula $$\begin{array}{c} [(CF_3)_2CFO(CF_2)_mCH_2CH(CH_2)_nCOOH]_2 \\ | \end{array}$$

where $m$ is an integer of 6 to 8 and $n$ is an integer of 6 to 10. Salts of such acids with a mild base such as ammonia and mixtures of such acids are also most preferred. Particular examples of the most preferred acids are $$\begin{array}{c} [(CF_3)_2CFO(CF_2)_mCH_2CH(CH_2)_8COOH]_2 \\ | \end{array}$$

wherein $m$ is 6 or 8, with other examples being found in Table 1 below.

The fluorinated acids should be used as aqueous acid solutions in suitable carrier solvent systems so as to form an aqueous solution having a pH between 5.5 and 6.5. The pH may be adjusted, if required, to between about 5.5 and about 6.5 with a mild base such as ammonia or a mild organic ammonia base.

In order to dissolve the acids in water to a concentration (weight %) of at least about 0.05 and preferably about 0.1 to about 1.0 and most preferably about 0.1 to about 0.4, a cosolvent may be necessary. Preferred cosolvents are both liquid and miscible with water from room temperature to about 100° C and increase the solubility of the acids to the desired level at room temperature and thus higher at about 98° C to about 100° C. Among the preferred cosolvents is the monoethyl ether of ethylene glycol, is sold under the trademark "Cellosolve" by Union Carbide and having the formula $HOCH_2CH_2OCH_2CH_3$. Other exemplary cosolvents include the monomethyl or monobutyl ethers of ethylene glycol and also tetrahydrofurfuryl alcohol.

The metal is preferably an aluminum or aluminum alloy which is anodized by oxidizing an outside layer to $Al_2O_3$. The preferred thickness of oxide is about 0.0002 to about 0.001 inch, with about 0.0002 to about 0.0004 being more preferred. The electrolyte should be thoroughly rinsed off before sealing. The sealing occurs by immersing the metal in the hot aqueous sealing solution at about 98° C to about 100° C, with reflux usually being conducted to retain vaporized solvent. The time required for sealing may vary, but is generally less than about 20 minutes, with the hydration of the oxide being completed by that time. The presence of the fluorochemical does not, in general, increase the sealing time compared to prior art processes using boiling water.

EXAMPLE 1

A dicarboxylic acid sample of 1 gram having the formula $[(CH_3)_2CFO(CF_2)_8CH_2CH(CH_2)_8COOH]_2$ is dissolved in 10 grams Cellosolve and added to 990 grams of 50% Cellosolve and 50% water premix by volume to produce the sealing solution. The sealing composition thus contains approximately 0.1% fluorochemical by weight. The pH was adjusted as needed to between 5.5 and 6.5 with ammonia.

EXAMPLE 2

Several 4-inch by 6-inch aluminum panels were cleaned and anodized electrically in a sulfuric acid bath at room temperature for 15 minutes to produce an oxide coating of about 0.0003 inch. The freshly anodized panels were rinsed thoroughly with distilled water and immersed at once in the solution of Example 1, contained in a tall beaker maintained at 98° C to 100° C for 20 minutes. The vessel was covered with an ice-cooled evaporating dish to obtain reflux. A comparison set of panels, anodized in the same baths, was sealed by immersion for 20 minutes in boiling water at 98° to 100° C and at same pH of 5.5 to 6.5.

EXAMPLE 3

Several plates, sealed in boiling water or in the solution of Example 1 were subjected to the FACT (Ford Anodized Aluminum Corrosion Test) as described by J. Stone et al. in PLATING, July 1966. Higher numbers (in volt seconds) represent better resistance to attack by acidified salt and an impressed voltage across the test cell in which the treated aluminum is the cathode. The mean of a large number of controls was about 960 volt-seconds, the mean of a large number of panels sealed in the solution of Example 1 was 2800 volt-seconds.

EXAMPLE 4

Another set of panels from Example 2, some sealed in the solution of Example 1, others sealed in water, were subjected to the Kape test described by J. M. Kape in the Sept. 18, 1959 issue of METAL INDUSTRY. This test measures weight loss as a percentage of total oxide content upon immersion in sulfite solution. The controls had a weight loss of 1–5%, the panels sealed with the solutions of Example 1 had a weight loss of 0 to 0.1% and showed little or no chalking or staining.

When the Kape and FACT tests are hybridized by (1) determining a FACT value, (2) giving the sulfite exposure part of the Kape test, (3) determining a second FACT value and (4) completing the Kape test, the water-sealed panels have a second FACT number of about 550–600 volt-seconds or within the range of unprotected metal. With solution-sealed panels, the second FACT value of 1400–1600 was still far superior to the FACT value of controls, even before sulfite attack.

Comparisons were made with fatty acids such as stearic, oleic and dimerized oleic acid (sold by Emery Industries under the trademark EMPOL 1010), each used instead of the fluorochemical of Example 1. Each showed values intermediate between the water-sealed control panels and the fluorochemical solution panels in the FACT test, but did not perform substantially better than the controls in the Kape test. Such fatty acids, and particularly the dicarboxylic acids $[CH_3(CH_2)_nCH(CH_2)_mCOOH]_2$, may be used in addition to the fluorochemicals of the present invention as extenders. For example 0.1% of dimerized oleic acid and 0.1% or even 0.05% of the acid of Example 1, both by weight, provides good protection.

EXAMPLE 5

Each of the dicarboxylic acids and salts of Table 1 is prepared and dissolved in an aqueous solution to the indicated concentration (weight %). Where necessary the indicated amount of fluorochemical is dissolved in the coupling solvent ethylene glycol monoethyl ether and water or water and coupling solvent is added at room temperature. Anodized aluminum plates and aluminum alloy 1100 strips having an aluminum oxide thickness of 0.0002, 0.0004, 0.0007 and 0.001 inch thickness are immersed in each solution under reflux conditions at 98° C to 100° C for about 20 minutes or until sealed to produce corrosion resistant anodized aluminum plates and strips.

TABLE $[R_f-(CX_2)_mCH_2CH(CX_2)_nCOOM]_2$

| $R_f-$ | $-(CX_2)_m-$ | $-(CX_2)_n-$ | M | Amount |
|---|---|---|---|---|
| $(CF_3)_3C(CF_2)_2-$ | $-(CH_2)_5-$ | $-(CF_2)_3-$ | H | 0.1% |
| $CF_3(CF_2)_2-$ | $-(CH_2)_3$ | $-(CH_2)_5-$ | H | 0.3% |
| $(CF_3)_2CF(CF_2)_{21}-$ | $-(CH_2)_{10}-$ | $-(CH_2)_7-$ | H | 0.2% |
| $CF_3(CF_2)_{10}-$ | $(CH_2)_4$ | $-(CH_2)_{10}-$ | H | 0.4% |
| $(CF_3)_2CFO-$ | $-(CF_2)_{10}-$ | — | $NH_4+$* | 1.0% |
| $(CF_3)(CF_2)_5O-$ | $-(CF_2)_2-$ | $-(CF_2)_2-$ | H | 1.0% |
| $(CF_3)_2CFO-$ | $-(CF_2)_3-$ | $-(CH_2)_5-$ | H | 0.5% |
| $(CF_3)_2CF(CF_2)_8-$ | — | $-(CH_2)_6-$ | H | 0.2% |
| $(CF_3)_2CF(CF_2)_8-$ | $-(CH_2)_4-$ | $-(CH_2)_5-$ | $NH_4+$* | 0.3% |
| $(CF_3)_2CF(CF_2)_3-$ | $-(CF_2)_4-$ | $-(CF_2)_3-$ | $NH_4+$* | 0.3% |
| $(CF_3)_2CFO-$ | $-(CF_2)_7-$ | $-(CH_2)_6-$ | H | 0.3% |
| $(CF_3)_2CFO-$ | $-(CF_2)_6-$ | $-(CH_2)_8-$ | H | 0.05% |

TABLE-continued $[R_f-(CX_2)_mCH_2CH(CX_2)_nCOOM]_2$

| $R_f-$ | $-(CX_2)_m-$ | $-(CX_2)_n-$ | M | Amount |
|---|---|---|---|---|
| $(CF_3)_2CFO-$ | $-(CF_2)_8-$ | $-(CH_2)_{10}-$ | H | 0.4% |
| $(CF_3)_2CF(CF_2)_9O-$ | $-(CH_2)_5-$ | $-(CH_2)_5-$ | H | 0.3% |
| $(CF_3)_2CFO-$ | $-(CF_2)_4(CH_2)_4-$ | $-(CH_2)_3-$ | H | 0.2% |
| $(CF_3)_2CFO-$ | $-(CF_2)_8(CH_2)_2-$ | $-(CH_2)_2-$ | H | 0.1% |

*A mixture of the ammonium salt and the acid at pH 5.5–6.5.

I claim:

1. A process for preparing a corrosion-resistant anodized metal substrate comprising the steps of anodizing a metal substrate selected from aluminum and its alloys to produce a metal oxide coating from about 0.0002 to about 0.001 inch thick and immersing the anodized metal in an aqueous solution having a pH of about 5.5 to about 6.5 and having at least about 0.05 weight % of a sealing agent selected from segmented polycarboxylic acids having a perfluorinated alkyl or alkoxy chain of at least three carbons, acidic salts of said segmented carboxylic acids and mixtures thereof at between about 98° C and about 100° C for a sufficient time to seal the metal oxide coating.

2. A process according to claim 1 wherein the metal substrate is aluminum.

3. A process according to claim 1 wherein the aqueous solution contains about 0.1 to about 1.0 weight % of said sealing agent.

4. A process according to claim 3 wherein the aqueous solution contains about 0.1% to about 0.4% of said sealing agent.

5. A process according to claim 1 wherein the sealing agent is selected from acids of the formula $$R_f(CX_2)_mCH_2CH(CX_2)_nCOOH$$
$$|$$
$$R_f(CX_2)_mCH_2CH(CX_2)_nCOOH$$

wherein X is independently at each occurrence H or F, $m$ and $n$ are independently an integer of 0 to 10 and $R_f$ is $C_pF_{2p+1}-$ where $p$ is an integer of 6 to 24 or $C_qF_{2q+1}O-$ where $q$ is an integer of 3 to 12, provided that when $q$ is less than 6, the adjacent $(CX_2)_m$ contains at least three perfluorinated carbons, salts of said acids and mixtures thereof.

6. A process according to claim 1 wherein said sealing agent is selected from acids of the formula $$C_qF_{2q+1}O(CF_2)_m(CH_2)_rCH(CX_2)_nCOOH$$
$$|$$
$$C_qF_{2q+1}O(CF_2)_m(CH_2)_rCH(CX_2)_nCOOH$$

where X is independently at each occurrence H or F, $m$ is an integer of 4 to 8, $n$ is an integer of 6 to 10, $q$ is an integer of 3 to 6, $r$ is an integer of 0–4 and salts of said acids and mixtures thereof.

7. A process according to claim 6 wherein $q$ is 3.

8. A process according to claim 1 wherein said sealing agent is selected from acids of the formula $$(CF_3)_2CFO(CF_2)_mCH_2CH(CH_2)_nCOOH$$
$$|$$
$$(CF_3)_2CFO(CF_2)_mCH_2CH(CH_2)_nCOOH$$

wherein $m$ is an integer of 6 to 8 and $n$ is an integer of 6 to 10, salts of said acids and mixtures thereof.

9. A process according to claim 1 wherein said metal oxide coating has a thickness of about 0.0002 to 0.001 inch.

10. A corrosion-resistant anodized metal substrate prepared by the process of claim 1.

11. A corrosion-resistant anodized metal substrate prepared by the process of claim 7.

* * * * *